US011608755B2

(12) United States Patent
Aramaki et al.

(10) Patent No.: US 11,608,755 B2
(45) Date of Patent: Mar. 21, 2023

(54) ASSEMBLY OR DISASSEMBLY METHOD FOR STEAM TURBINE CASING

(71) Applicant: Mitsubishi Heavy Industries, Ltd., Tokyo (JP)

(72) Inventors: Chikara Aramaki, Yokohama (JP); Asuka Nidome, Yokohama (JP)

(73) Assignee: Mitsubishi Heavy Industries, Ltd., Tokyo (JP)

( * ) Notice: Subject to any disclaimer, the term of this patent is extended or adjusted under 35 U.S.C. 154(b) by 0 days.

(21) Appl. No.: 17/410,505

(22) Filed: Aug. 24, 2021

(65) Prior Publication Data

US 2022/0065134 A1 Mar. 3, 2022

(30) Foreign Application Priority Data

Aug. 25, 2020 (JP) ..... JP2020-141404

(51) Int. Cl.
*F01D 25/26* (2006.01)
*F01D 25/28* (2006.01)
*F01D 25/24* (2006.01)

(52) U.S. Cl.
CPC ..... *F01D 25/28* (2013.01); *F01D 25/243* (2013.01); *F01D 25/26* (2013.01)

(58) Field of Classification Search
CPC ..... F01D 25/28; F01D 25/26; F01D 25/243; F01D 25/285; F01D 25/265; F05D 2220/31; F05D 2230/60; F05D 2230/70
See application file for complete search history.

(56) References Cited

U.S. PATENT DOCUMENTS 4,112,582 A * 9/1978 Beckershoff ..... F01D 25/24 33/655
7,581,922 B1 * 9/2009 Morimoto ..... F01D 25/285 415/126
8,834,113 B2 * 9/2014 Schaus ..... F01D 25/246 415/209.2

(Continued)

FOREIGN PATENT DOCUMENTS

DE 10 2012 106 447 A1 3/2013
JP 6-55385 A 3/1994

(Continued)

OTHER PUBLICATIONS

Hindi-language Office Action issued in Indian Application No. 202114036555 dated Mar. 22, 2022 with English translation (five (5) pages).

(Continued)

*Primary Examiner* — Eldon T Brockman
*Assistant Examiner* — Maxime M Adjagbe
(74) *Attorney, Agent, or Firm* — Crowell & Moring LLP

(57) ABSTRACT

An assembly or disassembly method for a casing of a steam turbine in which an inner casing is installed in an outer casing, and the inner casing and the outer casing are fixed at a fixing position, wherein when the inner casing is assembled or disassembled in a state where the fixing position and a gravity center of the inner casing are at different positions in an axial direction of the inner casing, a tilt adjusting jig is interposed between the outer casing and the inner casing so that the assembly or disassembly of the casing is performed while maintaining a tilt of the inner casing with the tilt adjusting jig.

7 Claims, 3 Drawing Sheets

(56) References Cited

U.S. PATENT DOCUMENTS

| | | | | |
|---|---|---|---|---|
| 8,870,529 | B2 * | 10/2014 | Casavant | F01D 25/28 415/126 |
| 2009/0081030 | A1 | 3/2009 | Sullivan et al. | |
| 2013/0022453 | A1 | 1/2013 | Schaus et al. | |

FOREIGN PATENT DOCUMENTS

| | | | |
|---|---|---|---|
| JP | 2011-43103 | A | 3/2011 |
| JP | 2014-231798 | A | 12/2014 |
| JP | 2018-48566 | A | 3/2018 |

OTHER PUBLICATIONS

German-language Office Action issued in German Application No. 102021209253.5 dated Jun. 30, 2022 with English translation (12 pages).

Japanese-language Office Action issued in Japanese Application No. 2020-141404 dated Dec. 6, 2022 with English translation (six (6) pages).

* cited by examiner

ASSEMBLY OR DISASSEMBLY METHOD FOR STEAM TURBINE CASING

CLAIM OF PRIORITY

The present application claims priority from Japanese Patent application serial No. 2020-141404, filed on Aug. 25, 2020, the content of which is hereby incorporated by reference into this application.

TECHNICAL FIELD

The present disclosure relates to an assembly or disassembly method for a casing of a steam turbine, and more particularly, to a preferred assembly or disassembly method for a casing of a steam turbine where an inner casing is assembled in or disassembled from an outer casing of the steam turbine.

BACKGROUND ART

In the steam turbine, the inner casing is normally installed in the outer casing, and the outer casing and the inner casing have their respectively formed seats locked to each other with bolt or the like. It is a common practice to assemble components such as rotor in the above-described inner casing.

Japanese Patent Application Laid-Open No. 1994-55385 is cited as one of the prior art documents related to the assembly of the steam turbine casing.

SUMMARY OF INVENTION

Technical Problem

In the above-described prior art, if an interlocking part (seat) between the inner casing and the outer casing to which the inner casing is mounted and a gravity center of the inner casing do not coincide with each other at the time of assembly or disassembly of these casings, the inner casing may lose balance and tilt.

Once the inner casing tilts, it is difficult to correct the tilt of the inner casing so that galling occurs at the interlocking part between the outer casing and the inner casing. This may result in a problem that the inner casing cannot be disassembled from the outer casing at the time of disassembly.

Accordingly, the present disclosure has been made in view of the foregoing, and an object of the present disclosure is to provide an assembly or disassembly method for a steam turbine casing, the method adapted to prevent the tilt of the inner casing even though a fixing position (interlocking part between the inner casing and the outer casing) to lock the inner casing in place and the gravity center of the inner casing do not coincide with each other at the time of casing assembly or disassembly, and to permit the inner casing to be assembled in or disassembled from the outer casing without mutual interference.

Solution to Problem

According to an aspect of the present disclosure for achieving the above object, an assembly or disassembly method for a casing of a steam turbine in which an inner casing is installed in an outer casing and the inner casing and the outer casing are fixed at a fixing position, wherein when the inner casing is assembled or disassembled in a state where the fixing position and a gravity center of the inner casing are at different positions in an axial direction of the inner casing, a tilt adjusting jig is interposed between the outer casing and the inner casing, and the assembly or disassembly of the casing is performed while maintaining a tilt of the inner casing with the tilt adjusting jig.

Advantageous Effects of Invention

According to the present disclosure, even though the fixing position (interlocking part between the inner casing and the outer casing) to fix the inner casing in position and the gravity center of the inner casing do not coincide with each other at the time of assembly or disassembly of the casing, the tilt of the inner casing can be prevented, and the inner casing can be assembled in or disassembled from the outer casing without mutual interference.

DESCRIPTION OF EMBODIMENTS

Figure 1:
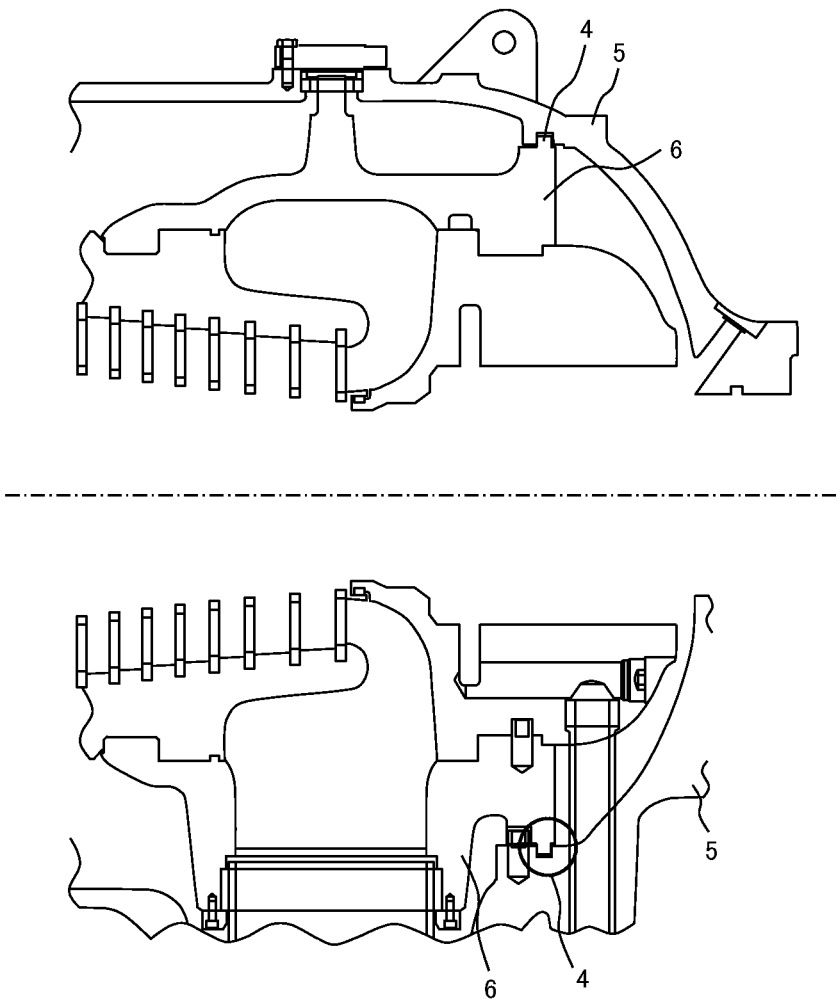
FIG. 1 illustrates a built-up sectional view of an inner casing and an outer casing of a steam turbine to which an assembly or disassembly method for steam turbine casing according to the present disclosure is applied.

The assembly or disassembly method for a casing of a steam turbine according to the present disclosure is explained as follows on the basis of the illustrated embodiment. In the drawings, the same reference signs are used for the same components.

FIG. 1 illustrates a built-up sectional view of an inner casing and an outer casing of a steam turbine to which an assembly or disassembly method for steam turbine casing according to the present disclosure is applied.

As illustrated in FIG. 1, an inner casing 6 is assembled in an outer casing 5. The inner casing 6 and the outer casing 5 are interlocked with each other at a fixing position (e.g., seat) 1 (not shown in the sectional view of FIG. 1 but refer to FIG. 4 (to be described hereinafter)).

Figure 2:
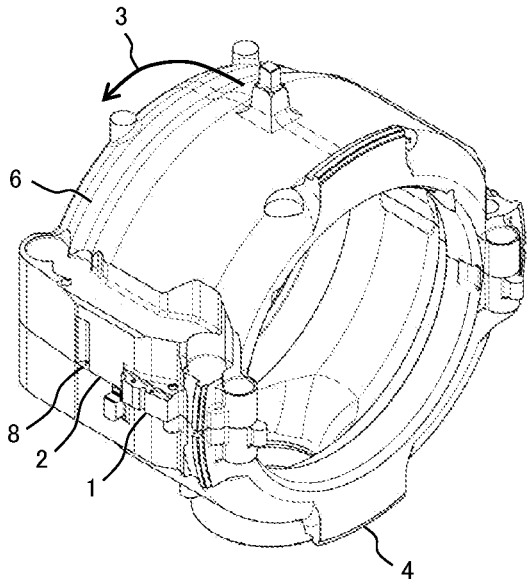
FIG. 2 illustrates a perspective view of the inner casing of FIG. 1.

FIG. 2 illustrates a perspective view of the inner casing 6 illustrated in FIG. 1.

In a state before some components (a rotor and the like) are assembled in the inner casing 6, a gravity center 2 of the inner casing 6 is normally located at a position axially shifted from a fixing position 1 of the inner casing 6 and the outer casing 5, as illustrated in FIG. 2. If the inner casing 6 is in this state, therefore, the inner casing 6 is liable to tilt from the fixing position 1 toward the gravity center 2 (direction of an arrow 3).

When the inner casing 6 tilts, galling may occur at an interlocking part 4 between concavity and convexity of the inner casing 6 and the outer casing 5.

Figure 3:
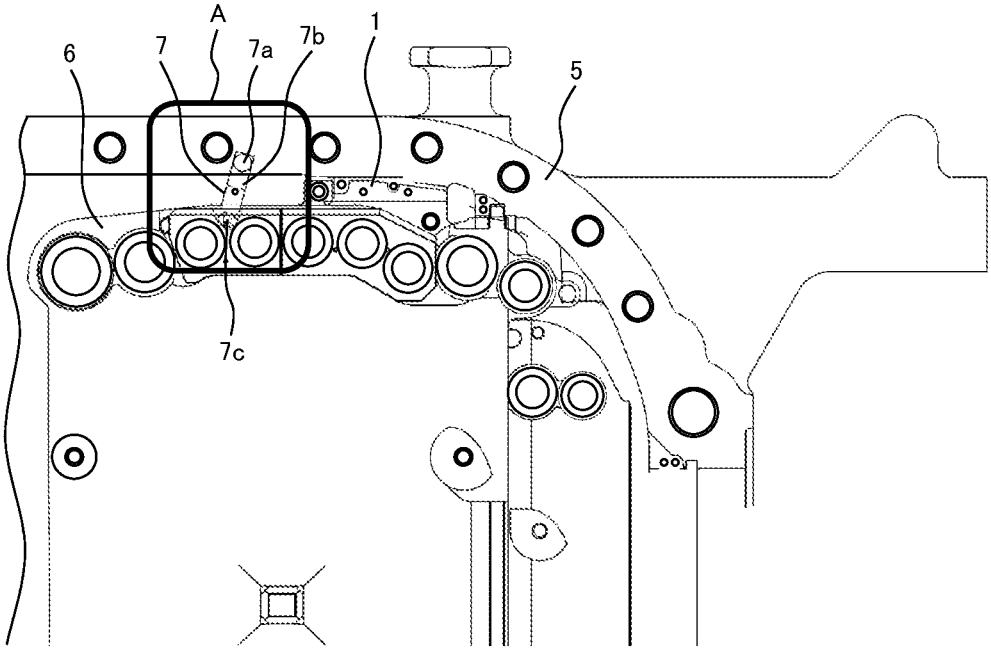
FIG. 3 illustrates a plan view of the inner casing and outer casing of FIG. 1 at the time of assembly as omitting an upper half of the outer casing.

FIG. 3 illustrates a plan view of the inner casing 6 and the outer casing 5 of FIG. 1 at the time of assembly as omitting an upper half of the outer casing 5.

In a case where the inner casing 6 is liable to tilt in the direction of the arrow 3, as illustrated in FIG. 2, a tilt adjusting jig 7 is interposed between the outer casing 5 and the inner casing 6 according to the embodiment so that the tilt of the inner casing 6 is maintained by the tilt adjusting jig 7. Otherwise, in a case where the inner casing 6 tilts further in the direction of the arrow 3, such a tilt is corrected by means of the tilt adjusting jig 7.

The above-described tilt adjusting jig 7 includes a bolt 7*a* as a first bolt, a block 7*b* and a fixing bolt (a hexagon socket head cap bolt) 7*c* as a second bolt. A through screw hole is formed at one end side of the block 7*b*, and the bolt 7*a* is screwed into the screw hole of the block 7*b*. The bolt 7*a* goes through the block 7*b*, and the tip of the bolt 7*a* is pressed against the outer casing 5. If necessary, a patch plate is placed between the tip of the bolt 7*a* and the outer casing 5. A through hole into which the fixing bolt 7*c* is inserted is formed on the other end side of the block 7*b*. The fixing bolt 7*c* goes through the block 7*b* and is screwed into a screw hole formed in the inner casing 6 to fix the block 7*b* to the inner casing 6. The inner casing 6 is pushed up via the fixing bolt 7*c* by tightening the bolt 7*a* so that the tilt of the inner casing 6 can be adjusted.

Figure 4:
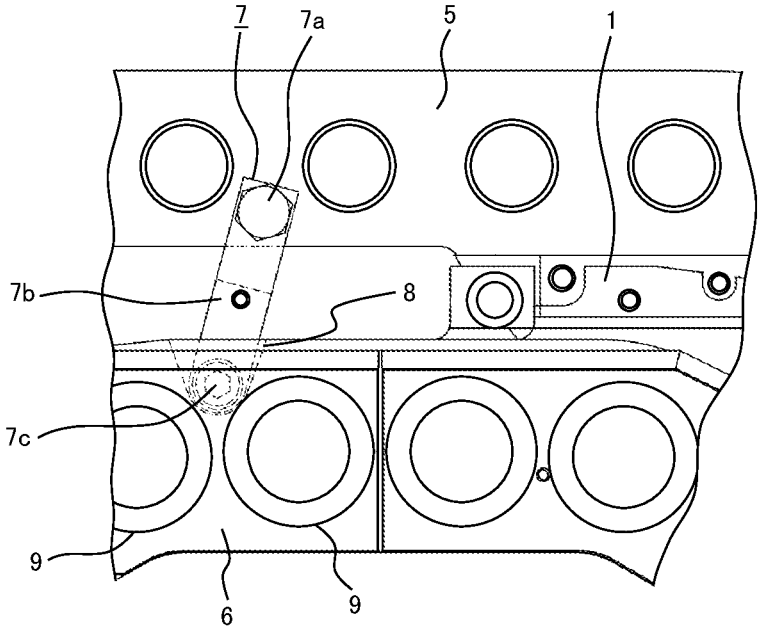
FIG. 4 illustrates an enlarged view of an A portion of FIG. 3.
Figure 5:
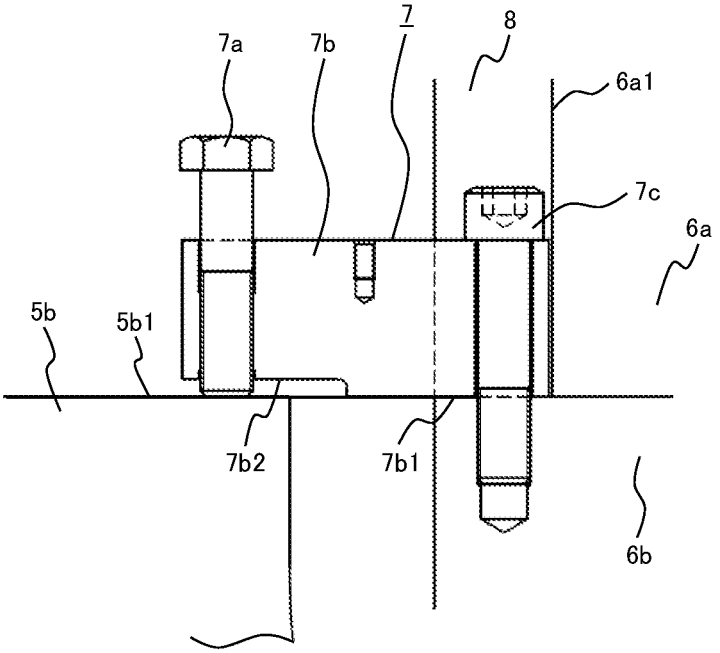
FIG. 5 illustrates a diagram of a tilt adjusting jig which is applied to the assembly or disassembly method for steam turbine casing of the present disclosure, as viewed from the left side of FIG. 4.

FIG. 4 illustrates an enlarged view of an A portion of FIG. 3. FIG. 5 illustrates a diagram of the tilt adjusting jig, as viewed from the left side of FIG. 4, which is applied to the assembly or disassembly method for steam turbine casing according to the embodiment.

As illustrated in FIG. 4 and FIG. 5, the tilt adjusting jig 7 of the embodiment is fixed as follows. The block 7*b* is fastened to the inner casing 6 by inserting the fixing bolt 7*c* through the block 7*b*. Subsequently, the tilt adjusting jig 7 is pressed against the outer casing 5 with the bolt 7*a*.

The fixing bolt 7*c* is disposed between inner casing fastening portions 9 for fastening together an upper half 6*a* and a lower half 6*b* of the inner casing 6.

A V-shaped portion illustrated by a dashed line in vicinity of the fixing bolt 7*c* is a notched portion 8 (see FIG. 2 for more specific position thereof) which is provided at a part (where the fixing bolt 7*c* is located) of the upper half 6*a* of the inner casing 6. This notched portion 8 permits the use of the tilt adjusting jig 7 to despite the existence of the upper half 6*a* of the inner casing 6.

Specifically, the notched portion (space area) 8 permits the fixing bolt 7*c* to be tightened when the tilt adjusting jig 7 is mounted to the lower half 6*b* of the inner casing 6 by means of the fixing bolt 7*c*. Thus, the tilt adjusting jig 7 can be mounted to the lower half 6*b* of the inner casing 6.

The tilt adjustment of the inner casing 6 is accomplished by using the tilt adjusting jig 7 according to the embodiment. Referring to FIG. 5, tightening the bolt 7*a* produces a force for the block 7*b* to push up the inner casing 6. The force acts to correct the tilt of the inner casing 6 for adjustment of the tilt of the inner casing 6.

Specifically, in conjunction with tightening the bolt 7*a*, the force pushing up the inner casing 6 fastened to the other end of the block 7*b* by means of the fixing bolt 7*c* is produced in the block 7*b*, one end of which is fixed in place by means of the bolt 7*a*. This force acts to correct the tilt of the inner casing 6 for tilt adjustment of the inner casing 6.

A lower base surface of the block 7*b* has a structure (step structure) where an inner casing side surface 7*b*1 of the block and an outer casing side surface 7*b*2 of block are varied in height so that the outer casing side surface 7*b*2 of the block 7*b* and a top side 5*b*1 of the lower half 5*b* of the outer casing 5 are in non-contact relation.

This relation permits the tilt adjusting jig 7 to be assembled in even in a state where the inner casing 6 is tilted.

The vertical line immediately to the right of the tilt adjusting jig 7 as seen in FIG. 5 is a wall surface 6*a*1 of the inner casing 6 when the notched portion 8 illustrated in FIG. 4 is formed.

The inner casing 6 is formed with the notched portion 8, via which the tilt adjusting jig 7 is fastened to the inner casing 6 by means of the fixing bolt 7*c*. The tilt adjusting jig 7 supports the lower half 6*b* of the inner casing 6 when the outer casing 5 and the inner casing 6 are interlocked at the fixing position 1. Subsequently, the tilt adjusting jig is used till an assembly step of the upper half 6*a* of the inner casing 6.

Just as described, the tightening of the bolt 7*a* causes the block 7*b* to apply the force pushing up the inner casing 6 so that the tilt of the inner casing 6 is adjusted. Therefore, a correct assembly of the components (the rotor and the like) inside the inner casing 6 can be ensured by installing the tilt adjusting jig 7 to correct the tilt of the inner casing 6 and then to maintain the inner casing 6 in the correct position.

According to the embodiment, even though the fixing position (interlocking part 4) of the inner casing 6 and the gravity center 2 of the inner casing 6 do not coincide with each other at the time of disassembly or assembly of the casings of the steam turbine, the tilt of the inner casing 6 can be adjusted by means of the adjusting jig 7. This permits the inner casing 6 to be assembled to the outer casing 5 or to be disassembled from the outer casing 5 without mutual interference. When the assembly of the inner casing 6 is completed, the tilt adjusting jig 7 is removed to be ready for mounting an upper half of the outer casing 5.

The embodiment illustrates the example where the tilt adjusting jig 7 is used when the inner casing 6 is assembled to the outer casing 5. Further, the tilt adjusting jig 7 is also usable when the inner casing 6 is disassembled from the outer casing 5 so long as the adjusting jig 7 is used the same way.

It is noted that the present invention is not limited to the above-described embodiment but can include a variety of modifications. The foregoing embodiment, for example, is the detailed illustration to clarify the present invention. The embodiment is not necessarily limited to those including all the components described above. Some component of one embodiment can be replaced by some component of another embodiment. Further, some component of one embodiment can be added to the arrangement of another embodiment. A part of the arrangement of each embodiment permits addition of some component of another embodiment, the omission thereof or replacement thereof.

REFERENCE SIGNS LIST

1: fixing position of inner casing and outer casing
2: gravity center of inner casing
3: tilt direction of inner casing
4: interlocking part between concavity and convexity of inner casing and outer casing
5: outer casing
5*b*: lower half of outer casing
5*b*1: top side of lower half of outer casing
6: inner casing
6*a*: upper half of inner casing
6*b*: lower half of inner casing
6*a*1: wall surface of inner casing
7: tilt adjusting jig

7*a*: bolt of tilt adjusting jig
7*b*: block of tilt adjusting jig
7*b*1: inner casing side surface of block
7*b*2: outer casing side surface of block
7*c*: fixing bolt of tilt adjusting jig
8: notched portion
9: inner casing fastening portion

The invention claimed is:

1. An assembly method for a casing of a steam turbine in which an inner casing is installed in an outer casing, and the inner casing and the outer casing are fixed at a fixing position, the assembly method comprising:

when the inner casing is assembled in a state where the fixing position and a gravity center of the inner casing are at different positions in an axial direction of the inner casing, interposing a tilt adjusting jig between the outer casing and the inner casing so that the tilt adjusting jig is positioned on an opposite side of the axial direction from the fixing position as viewed from the gravity center of the inner casing; and performing the assembly of the casing while maintaining or correcting a tilt of the inner casing from the fixing position in the direction of the gravity center with the tilt adjusting jig.

2. The assembly method for a casing of a steam turbine according to claim 1, wherein the tilt adjusting jig is fastened to the inner casing, and the assembly of the casing is performed while maintaining the tilt of the inner casing with the tilt adjusting jig.

3. The assembly method for a casing of a steam turbine according to claim 2, wherein the tilt adjusting jig includes: a block; a first bolt; and a second bolt, the block provided with a through screw hole at one end side and a through hole at the other end side, the first bolt screwed into the through screw hole and a tip of the first bolt pressed against the outer casing, and the second bolt inserted into the through hole and screwed into a screw hole formed in the inner casing, and the inner casing is pushed up via the second bolt by tightening the first bolt so that the tilt of the inner casing is adjusted.

4. The assembly method for a casing of a steam turbine according to claim 3, wherein fastening the tilt adjusting jig to the inner casing is performed by inserting the second bolt through the block so as to fasten the block to the inner casing, followed by pressing the tilt adjusting jig against the outer casing with the first bolt so as to fix the tilt adjusting jig in position.

5. The assembly method for a casing of a steam turbine according to claim 3, wherein the inner casing includes an upper half and a lower half, and the inner casing is formed with a notched portion at place where the second bolt is located, and the tilt adjusting jig is mounted to the lower half of the inner casing by tightening the second bolt via the notched portion.

6. The assembly method for a casing of a steam turbine according to claim 3, wherein the inner casing and the outer casing each include an upper half and a lower half, and the tilt of the inner casing is adjusted by: tightening the first bolt to bring the tip of the first bolt into abutment against a top side of the lower half of the outer casing; and further tightening the first bolt to produce, in the block having the one end side fixed in position by the first bolt, a force pushing up the inner casing secured to the other end side of the block by the second bolt, so that the force acts to correct the tilt of the inner casing.

7. The assembly method for a casing of a steam turbine according to claim 6, wherein a lower base surface of the block has a step structure where an inner casing side surface and an outer casing side surface are varied in height, and when the tilt of the inner casing is adjusted, the step structure permits the assembly of the tilt adjusting jig even in a state where the inner casing is tilted.

* * * * *